United States Patent [19]

Hare

[11] 4,404,838

[45] Sep. 20, 1983

[54] SYSTEM FOR STRAIGHTENING BENT AUTOMOBILE BODIES

[76] Inventor: Charles E. Hare, 23 Franklin Valley Cir., Baltimore, Md. 21136

[21] Appl. No.: 286,086

[22] Filed: Jul. 23, 1981

[51] Int. Cl.[3] ..... B21D 1/12

[52] U.S. Cl. ..... 72/457; 72/705

[58] Field of Search ..... 72/457, 705; 269/909

[56] References Cited

U.S. PATENT DOCUMENTS

| | | | |
|---|---|---|---|
| 3,583,203 | 6/1971 | Williams | 72/446 |
| 3,626,747 | 12/1971 | Rouis | 72/453 |
| 3,777,541 | 12/1973 | Whitney | 72/457 |
| 3,835,692 | 9/1974 | Hoffman | 72/442 |
| 3,835,693 | 9/1974 | Majersky | 72/457 |
| 4,050,287 | 9/1976 | Borup | 72/457 |
| 4,055,061 | 10/1977 | Bayergeon et al. | 72/32 |
| 4,070,899 | 1/1978 | Venalainen | 72/705 |
| 4,088,002 | 5/1978 | Andrews | 72/705 |
| 4,174,623 | 11/1979 | LeGrand | 72/34 |
| 4,238,951 | 12/1980 | Grainger et al. | 72/457 |
| 4,281,532 | 8/1981 | Covington | 72/705 |
| 4,289,016 | 9/1981 | Hare | 72/705 |

FOREIGN PATENT DOCUMENTS

| | | | |
|---|---|---|---|
| 2606806 | 8/1977 | Fed. Rep. of Germany | 72/705 |
| 2718241 | 11/1978 | Fed. Rep. of Germany | 72/705 |
| 2745807 | 4/1979 | Fed. Rep. of Germany | 72/705 |
| 2246322 | 5/1975 | France | 72/705 |
| 338753 | 9/1971 | Sweden | 72/705 |

*Primary Examiner*—Lowell A. Larson

*Attorney, Agent, or Firm*—John F. McClellan, Sr.

[57] ABSTRACT

A portable anchoring system forms a height-adjustable rectangular frame extending outwardly all around an automobile body to which holding devices adjustably mounted on it clamp, providing a self-anchoring base to which conventional "pull dozers" can be chained and apply pulling and pushing forces without need for floor anchorage; to assemble the frame, a pair of side assemblies movably supported in use-attitude on transfer-ball-equipped jack-bases provide adjustable clamps which extend inwardly for affixation to a vehicle body to be repaired, and after clamping are joined by two end rails; an adjustable cross-bar is provided for applying pushing and pulling forces beneath a vehicle body.

3 Claims, 4 Drawing Figures

SYSTEM FOR STRAIGHTENING BENT AUTOMOBILE BODIES

FIELD OF THE INVENTION

This invention relates generally to automotive repair and particularly to anchoring systems for use in straightening bent automobile bodies and the like.

BACKGROUND OF THE INVENTION

Various types of frames for auto body work are known as indicated by the following patents, many of which disclose exerting pulling forces through the frame, not the floor of a building:

U.S. PAT. NOS.

3,583,203 to O. R. Williams, June 8, 1971, discloses a vehicle-surrounding frame (FIG. 10) and also a vehicle supporting frame on wheels and means on the frame for pulling body portions outward, and anchor means 16;

3,626,747 to R. J. Rouis, Dec. 14, 1971, discloses a vehicle supporting frame type straightening machine with adjustable pull mechanism 51;

3,777,511 to W. D. Whitney, Dec. 11, 1973, discloses a vehicle supporting frame on wheels, with body straightening provisions including means for anchoring a chain (FIG. 4) for outward pull on body portions;

3,835,692 to R. B. Hoffman, Sept. 17, 1974, discloses a length-telescoping frame-straightener, adjustable in width also, on castors, and with body-pulling equipment associated with it;

3,835,693 to A. S. Majersky, Sept. 17, 1974, discloses a vehicle-supporting castor-mounted frame with height adjustment and body-pulling provisions;

4,050,287 to J. Borup, Sept. 27, 1977, discloses body-holding mechanism adjustably held outboard a frame which is on castors;

4,055,061 to J. T. Bayergeon and others, Oct. 27, 1977, discloses a vehicle-supporting rolling frame with height adjustment and connectors and pulling means for body-straightening;

4,174,623 to P. N. LeGrand and others, Nov. 20, 1979, discloses a vehicle-supporting, body holding and straightening device on castors with means for pulling to the frame of the device;

4,238,951 to J. D. Grainger and H. A. Grainger, Dec. 16, 1980, discloses a simple rectangular frame telescoping to adjust in width and length with body-grippers at the corners. This could be easy to break down for storage.

FOREIGN PATENT

West German Patent No. 2,718,241, Nov. 2, 1978, (Volkswagen) discloses a castor-mounted frame held together by bolts at the corners, with stub-mounted body grippers 42 adjustably extending inwardly. There is a dozer-like upright that can be used for exerting pulling force between vehicle and frame. The device folds for storage.

OBJECTS OF THE INVENTION

From the above patents the relative complexity and variety of anchoring systems for auto body work shows that no one system has become the commercial standard.

A principal object of the present invention is to provide an anchoring system for auto body work in which a new combination of speed, accuracy, ease of operation and economy can make it a standard in the industry for unitized bodies as well as frame-type bodies.

Further objects are to provide a system as described which can be knocked-down for storage in ten minutes and can be set up for use in twenty minutes.

Still further objects are to provide a system as described which is stable and secure, with which a pull or a push can be applied safely from any position around an automobile body or from beneath an automobile body, without the need for floor anchors, in most situations using almost any conventional type "dozer" to apply the force needed.

Yet further objects are to provide a system as described which uses standard, readily available tubing and jacks, and has no critical dimensions, so that is requires a minimum of fabrication, and that consisting largely of sawing to length, drilling and welding.

BRIEF SUMMARY OF THE INVENTION

In brief summary given as cursive description only and not as limitation, the invention includes a portable anchoring system proportioned and expandable to extend at all points beyond an automobile body to be mounted on it but with grippers adjustably reaching inward to hold the automobile body pinch weld, with height adjustment, quick set-up and knock-down by telescoping attachment and detachment of side assemblies, and in preferred embodiment with rollers.

DETAILED DESCRIPTION OF THE DRAWINGS

Figure 1:
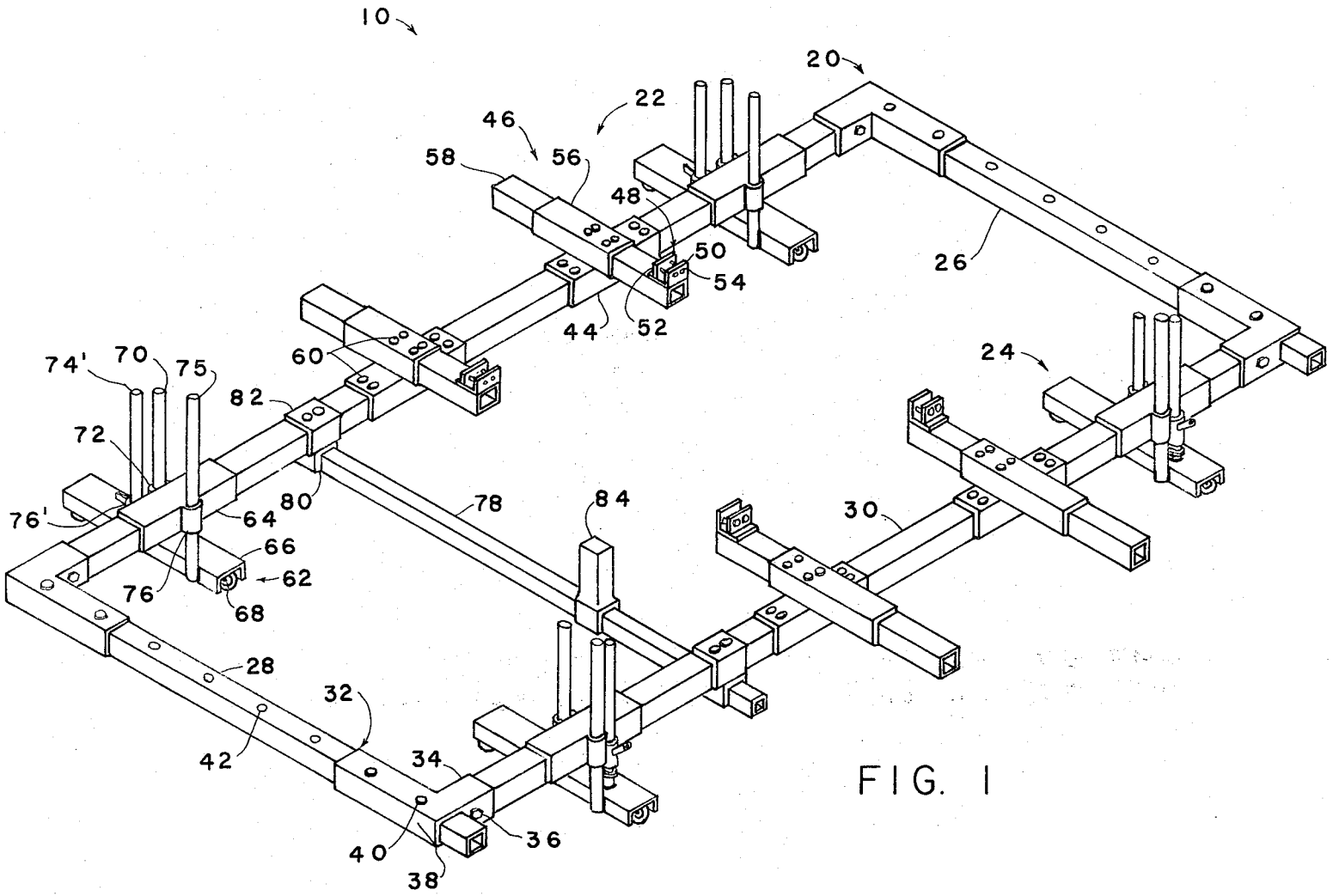
FIG. 1 is a perspective view showing general relation of parts of the invention.

FIG. 1 shows the invention 10 assembled. It includes a rectangular frame 20 made of first and second side assemblies 22, 24 and first and second straight end rails 26, 28 which pull out to adjust and to come apart for storage like a bed frame, in quick-attach/detach operation.

When apart, the side assemblies can be pushed against a wall and the end rails laid with them, taking up very little room as compared with non-take-down types.

Each side assembly includes a straight length of rectangular-section tubing or side rail 30 and has at each end a unitary "L"-shaped angle member or corner 32 of rectangular-section tubing of a size receiving within a first leg 34 of the "L" an end of the side rail 30. A bolt 36 detachably secures an end of the side rail 30 within the first leg 34 of the "L" short of the second leg 38 of the "L".

The second leg 38 of each "L" is open at each end and slidably receives an end rail 28, for example, which can adjust in position in it by means of a retainer pin 40 passing through aligned holes in the top and bottom walls of the second leg and engaging selected matching holes in a series 42 along the end rail, or more simply which can adjust by means of set screws located similarly. Means permitting application of straightening force to a car body through the frame independent of outside support includes provisions that length of the side assemblies is made greater than the length of vehicles to be repaired and adjustment of the end rails is enough to space the side rails wider apart than the sides of the vehicles to be repaired.

Each side rail 30 mounts slidably along itself by means of a length of tubing, or slide tube 44, a pair of holding devices 46, each with an auto-body-holding clamp 48 composed of an upwardly open set of a vise-like fixed jaw 50 and movable jaw 52 clampable against it by machine screws 54 operable from the outboard side. Each holding device is inwardly adjustable from tubing 44 by means of a second piece or cross-slide tubing 56 welded at right angles to the first, and slidably mounting in it a third or extension-piece of tubing 58 on the top of which the fixed jaw 50 is held by bolting or by welding.

To fix the positions of the holding devices set-screws 60 threaded through the tubing 56, 44, and bearing on the tubing 58 and the side pieces 30 may be used.

Means for raising and lowering the frame is provided in the form of a jack assembly 62 mounted slidably along each side or rail 30 adjacent each corner by means of a length of tubing 64.

Each jack assembly includes a long base 66 having at the ends underneath, ball transfers or castor means 68 for rolling the frame side assembly components, or the frame as a whole when assembled. The base is transverse to the frame and the base spaces the rollers far enough apart to hold the side rail assembly upright on the jacks when the side rail assemblies are unsupported by cross-members. This is very important in assembly around a vehicle-body, as will be seen, as well as for easy storage.

Welded upright on the base is a jack standard 74' of any conventional type, preferably a "Volkswagen" frictional-jack type. The lifting platform 76' of this jack is welded to the length of square tubing 64 slidably mounted on the side rail 30, so that operation of the jack raises and lowers the frame as required. Welded upright on the jack base 66 on the inner side is a stabilizer rod 75 which passes through a vertical sleeve 76 welded to the inner side of the tubing 64 and helps stabilize the jack assembly at all heights. A second stabilizer rod 70 is welded on the outside and has a corresponding sleeve 72 so that these guide means have the jack between them.

Because straightening loads are not transferred to the floor, the jack assemblies hold themselves in place without need for set-screws.

A crossbar 78 for pushing and pulling operations under a vehicle body slidably mounts within a length of square tubing 80 slidably held on each side rail 30 by a second length of square tubing 82 welded at right angles to the first. The crossbar can serve as a jack support for pushing, and as a hoist anchor for pulling. A sliding upright 84 may be employed on the crossbar as a brace or fulcrum.

Position of the cross bar may be locked by set-screws 60 like the locking of the other elements described.

Figure 2:
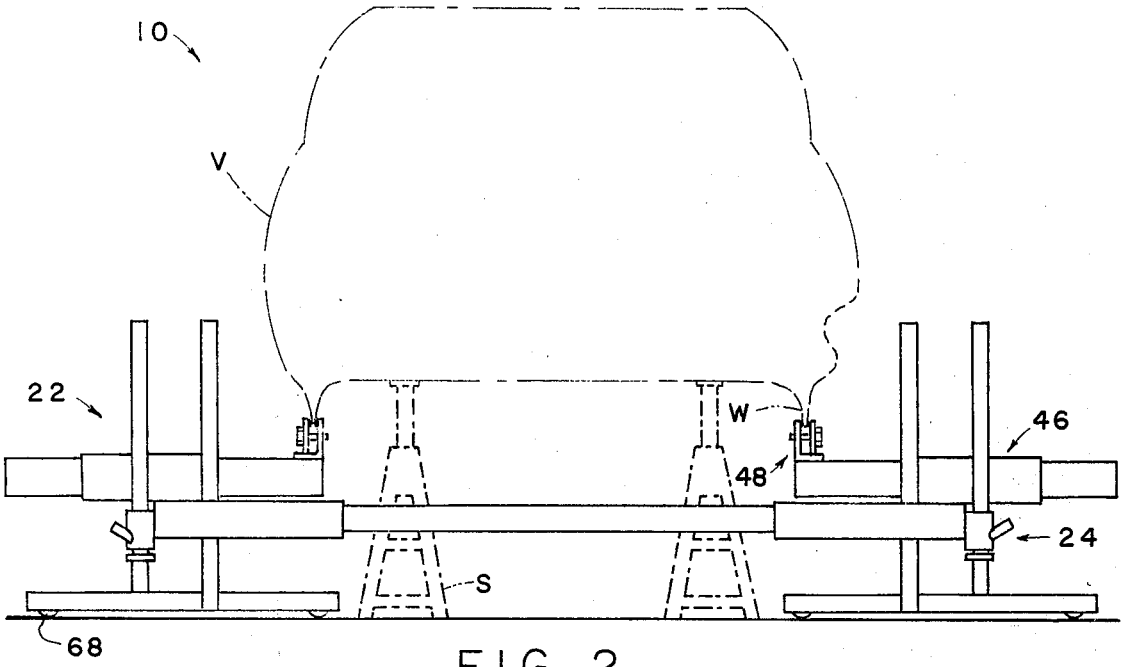
FIG. 2 is an end-elevational fragmentary schematic detail showing parts of the invention in working relation.

FIG. 2 shows a detail of the invention 10 in use forming a rectangular frame around a vehicle, following these directions.

First, raise the vehicle V and put conventional stands S under it at the suspension areas.

Second, independently roll the side assemblies 22, 24 to the vehicle; the roller means 68 make this easy and fast.

Third, independently raise the side assemblies on the jack standards to the level at which the holding devices 46 can clamp the pinch welds W of the rocker panels of the vehicle.

Fourth, tighten the clamps 48.

Fifth, install the end rails, and the cross bar 78, if it will be used, uniting the side assemblies.

Sixth, lock the positions of all slidable mounts except the member 64 which need no locking.

Figure 3:
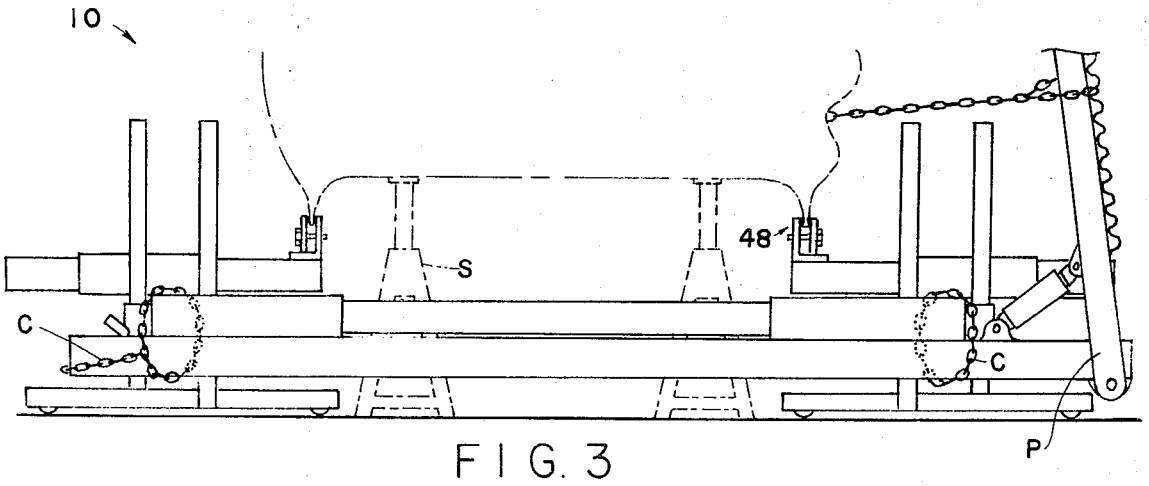
FIG. 3 is a fragmentary schematic detail, partly in cross-section, showing relation of parts of the invention to a conventional dozer-type mechanism applying a pulling force to one side of an automobile body being straightened.

FIG. 3 shows that the user is now in position to make a push or a pull on the vehicle body in any direction around the vehicle body, simply by attaching any conventional type "pull dozer" P to the frame in desired location, as by chains C.

The drawings are examples only; cross-sectional dimensions and the like may be made different without departing from the spirit of the invention. In preferred embodiment, dimensions may be as follows:

Overall length—14 feet (4.3 m)

Width (widest adjustment)—7 feet (2.1 m)

Width (narrowest adjustment) 3 feet (0.85 m)

Outer telescoping tubing cross-section dimensions—4 by 6 by $\frac{1}{4}$ by 12 feet long (0.1 by 0.15 by 0.006 by 3.7 m)

Inner telescoping tubing cross-section dimensions—cross-section to make sliding fit inside outer telescoping tube; length 14 feet (4.3 m)

Typical slide-tube length—14 inches (0.36 m)

In-and-out travel of holding devices—22 inches (0.55 m)

Range of jacking height—6 inches to 16 inches (0.15 to 0.4 m).

Spacing between ball transfers or castors on base of jacks—15 inches (0.38 m) on centers Base length may be 2 ft (0.6 m)

Figure 4:
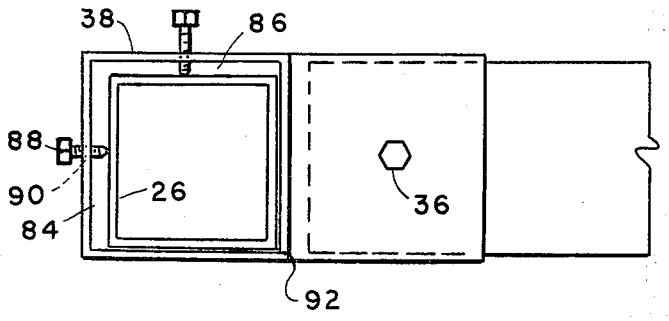
FIG. 4 is an end elevational detail.

FIG. 4 shows a further, preferred, feature of this invention, in a large-scale detail.

As noted, the end rails 26 are assembled last in a preferred mode of assembly, the side assemblies (22, 24 FIG. 1) being rolled into place and clamped to the body to be straightened. To relieve the requirement of exact alignment of the end rails when thrust into place in the second legs 38 of the "L" shaped members, the end rails and "L" shaped members may be provided with respective clearances 84, 86 both of which may be of $\frac{3}{8}$ inch (9 mm) dimension. These are shown at one side of the end rail and on top of the end rail as lateral clearance and vertical clearance. This clearance feature permits the end rails to be thrust through the side assemblies easily and quickly, even though somewhat misaligned. To tighten and fix the end rails accurately in place after insertion, set screws 88 (preferably two, spaced apart, at each location) are provided through respective tapped holes 90 in a side wall and top of the "L" shaped portion to drive the end rails down and across into a corner 92 of each "L" shaped member and accurately and reproducibly position them. The bolts 36 may then be tightened, fixing the sliding motion accommodative of the end rail installation.

The cross bar 78 (FIG. 1) may be added when needed and fixed by set screws like 60.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for straightening bent automobile bodies and the like and having a frame (20) of generally rectangular proportions including means (62) for raising and lowering the frame and means (48) for clamping it to an automobile body, the improvement comprising: the frame (20) having as components: first and second side-assemblies (22, 24), each having first and second ends; means permitting the first and second side-assemblies to be independently moved to corresponding sides of an automobile body and clamped to the automobile body by said clamping means, including respective means (66) transverse to each of said first and second side-assemblies (22, 24) for holding the first and second side assemblies upright while being independently moved to a corresponding side of an automobile body and clamped to the automobile body by said clamping means (48), first and second end rails (26, 28), quick-attach means (32) for adjustably joining respective first and second ends of said side assemblies after said clamping to an automobile body; means (58) for extending the clamping means (48) inward of said frame, means (46) for adjusting the position of said means for extending; means permitting application of straightening forces to a car body inward through said clamping means (48) including the frame (20) being larger across than automobiles to be straightened using the frame; said means (66) for holding upright being a part of the means (62) for raising and lowering; each means (62) for raising and lowering including a said means for holding upright in the form of a base (66), roller means (68) on the base, a jack (74', 76') on the base and having a jacking connection (76') for raising and lowering the frame; each of said first and second side-assemblies including a respective side rail (30), and means (64) mounting said means for raising and lowering slidably along the side rails.

2. In a system as recited in claim 1, guide means (70, 72, 75, 76) between said base (66) and frame adjacent each jack (75', 76') for stabilizing said jacks, each said guide means including a rod (70, 75) attached to said base (66), a vertical sleeve (72, 76) receiving said rod slidably, the vertical sleeve attached to said means (64) slidably mounting said means (62) for raising and lowering; each quick-attach means (32) including an angle member (34, 38) at each end of each side assembly with provision (36, 40) for adjustably fixing an end portion of each respective end rail (26, 28) to a respective side assembly (22,24), said means permitting including each end rail (26, 28) proportioned for providing misalignment clearance with a respective angle member (34, 38), said means (46) for adjusting the position of said means (58) for extending including a cross-slide member (56, 44) first tube (44) and a second tube (56) affixed transversely across the top of the first tube (44), the first tube (44) slidable on a side rail (30), the second tube (56) slidably receiving therethrough the means (58) for extending the clamping means, and screw means (60) for fixing the position of said first tube (44) and said means (58) for extending.

3. In a system as recited in claim 1, each quick attachment means including an angle member at each end of each side assembly each said end rail and angle member being of rectangular cross-section; said means permitting further including means for relieving requirement of exact alignment of end rail and angle member in attaching said side assemblies, comprising the proportions of each said end rail and angle member providing lateral clearance and vertical clearance for insertion of end rail into angle member when misaligned; and means for aligning the end rail and angle member, comprising means for driving the end rail into a corner of the angle member and fixing the end rail in said corner.

* * * * *